United States Patent [19]

Cowley et al.

[11] Patent Number: 4,552,140

[45] Date of Patent: Nov. 12, 1985

[54] EMERGENCY ESCAPE DEVICE

[75] Inventors: John J. Cowley, Toronto, Canada; Selby D. Hussey, Vernon Hills, Ill.

[73] Assignee: Erie Manufacturing Co., Milwaukee, Wis.

[21] Appl. No.: 490,034

[22] Filed: Apr. 29, 1983

[51] Int. Cl.[4] ..... A62B 7/00

[52] U.S. Cl. ..... 128/201.25; 128/204.25; 128/205.28

[58] Field of Search ..... 128/201.23, 201.25, 128/201.26, 201.28, 201.29, 202.19, 202.26, 204.25, 205.24, 205.25, 205.28

[56] References Cited

U.S. PATENT DOCUMENTS

| | | | |
|---|---|---|---|
| 2,456,130 | 12/1948 | Lambertsen | 128/202.19 |
| 3,080,586 | 3/1963 | Steinke . | |
| 3,292,821 | 12/1966 | Cowley . | |
| 3,392,724 | 7/1968 | Cowley . | |
| 3,432,060 | 3/1969 | Cowley . | |
| 3,438,060 | 4/1969 | Lobelle et al. | 128/201.23 |
| 3,491,752 | 1/1970 | Cowley . | |
| 3,502,075 | 3/1970 | Cowley . | |
| 3,505,996 | 4/1970 | Cowley . | |
| 3,505,997 | 4/1970 | Cowley . | |
| 3,507,621 | 4/1970 | Goodman et al. . | |
| 3,577,988 | 5/1971 | Jones | 128/201.25 |
| 3,762,407 | 10/1973 | Shonerd . | |
| 3,762,604 | 10/1973 | Shonerd . | |
| 3,854,495 | 12/1974 | Cowley . | |
| 3,906,945 | 9/1975 | Netteland et al. . | |
| 3,976,063 | 8/1976 | Henneman et al. | 128/201.25 |
| 4,005,708 | 2/1977 | Netteland et al. | 128/205.28 |
| 4,172,455 | 10/1979 | Beaussant . | |
| 4,221,216 | 9/1980 | Kranz . | |
| 4,236,514 | 12/1980 | Moretti | 128/201.23 |

*Primary Examiner*—Henry J. Recla

*Attorney, Agent, or Firm*—Andrus, Sceales, Starke & Sawall

[57] ABSTRACT

An emergency escape device includes a transparent impervious flexible hood to be placed over a user's head sealingly affixed to an inflatable collar. An annular saddle-shaped reservoir contains a supply of pressurized oxygen gas and is concentrically positioned on the collar so that when the collar is inflated the weight of the reservoir seals the collar around the user's neck. A control mechanism is actuatable by the user for delivering the oxygen to simultaneously fill the hood and inflate the collar. A scrubber is located within the hood for cleansing carbon dioxide from the exhalations of the user to enable the hood gas to be rebreathed by the user. An ejector is connected to the oxygen supply line and is located adjacent the scrubber to create a venturi effect to cause the hood gas to pass through the scrubber and enable the hood gas to be recycled.

14 Claims, 6 Drawing Figures

FIG. 1
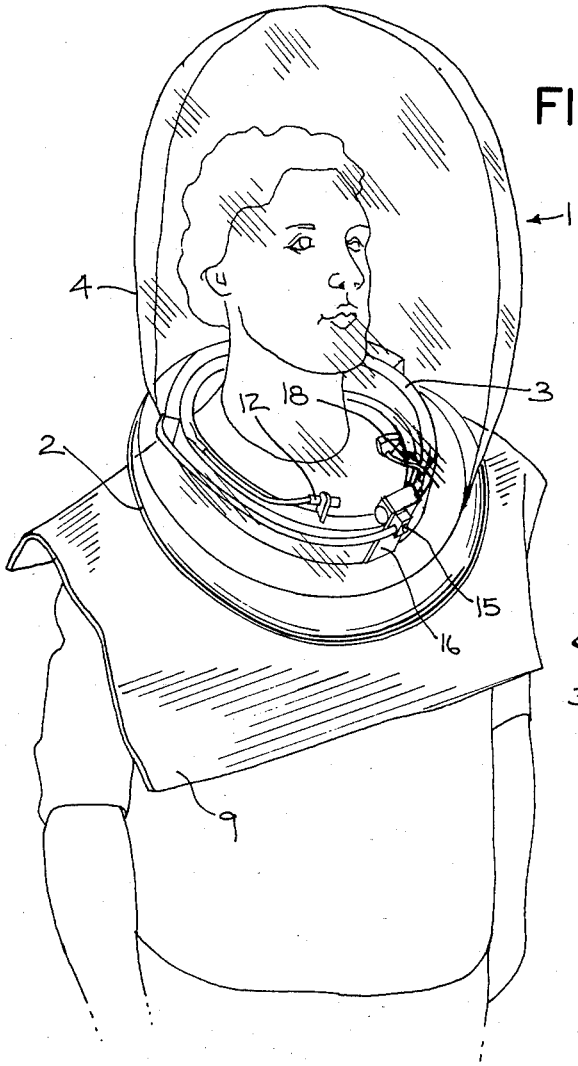
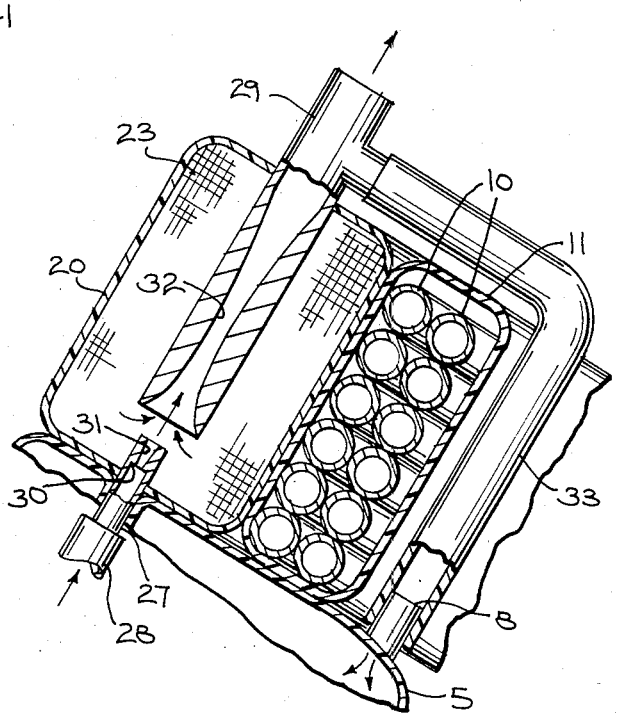
FIG. 4
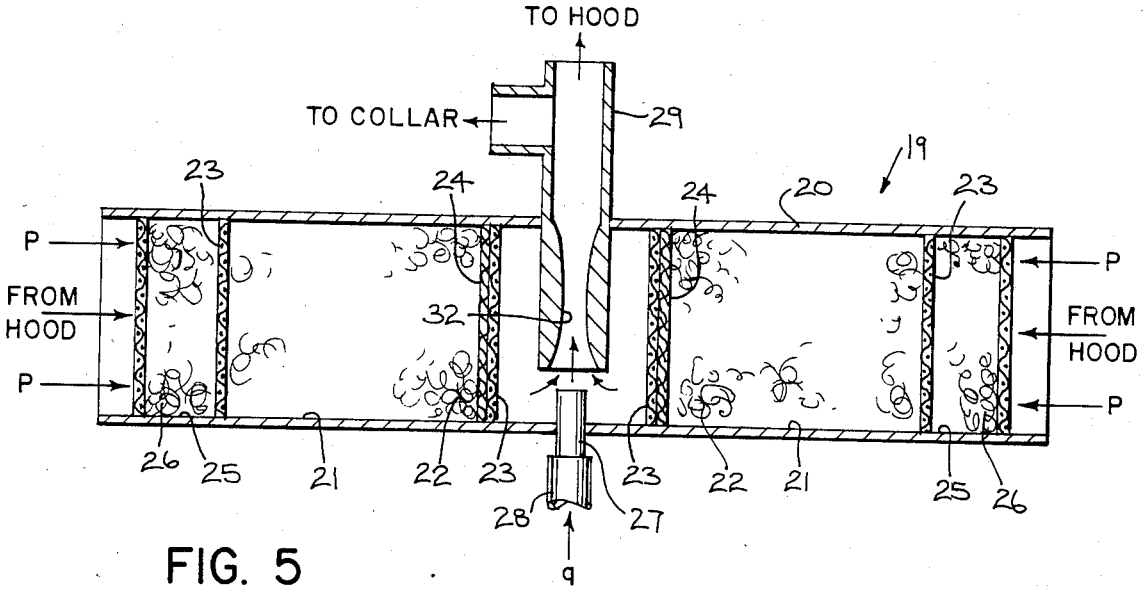
FIG. 5

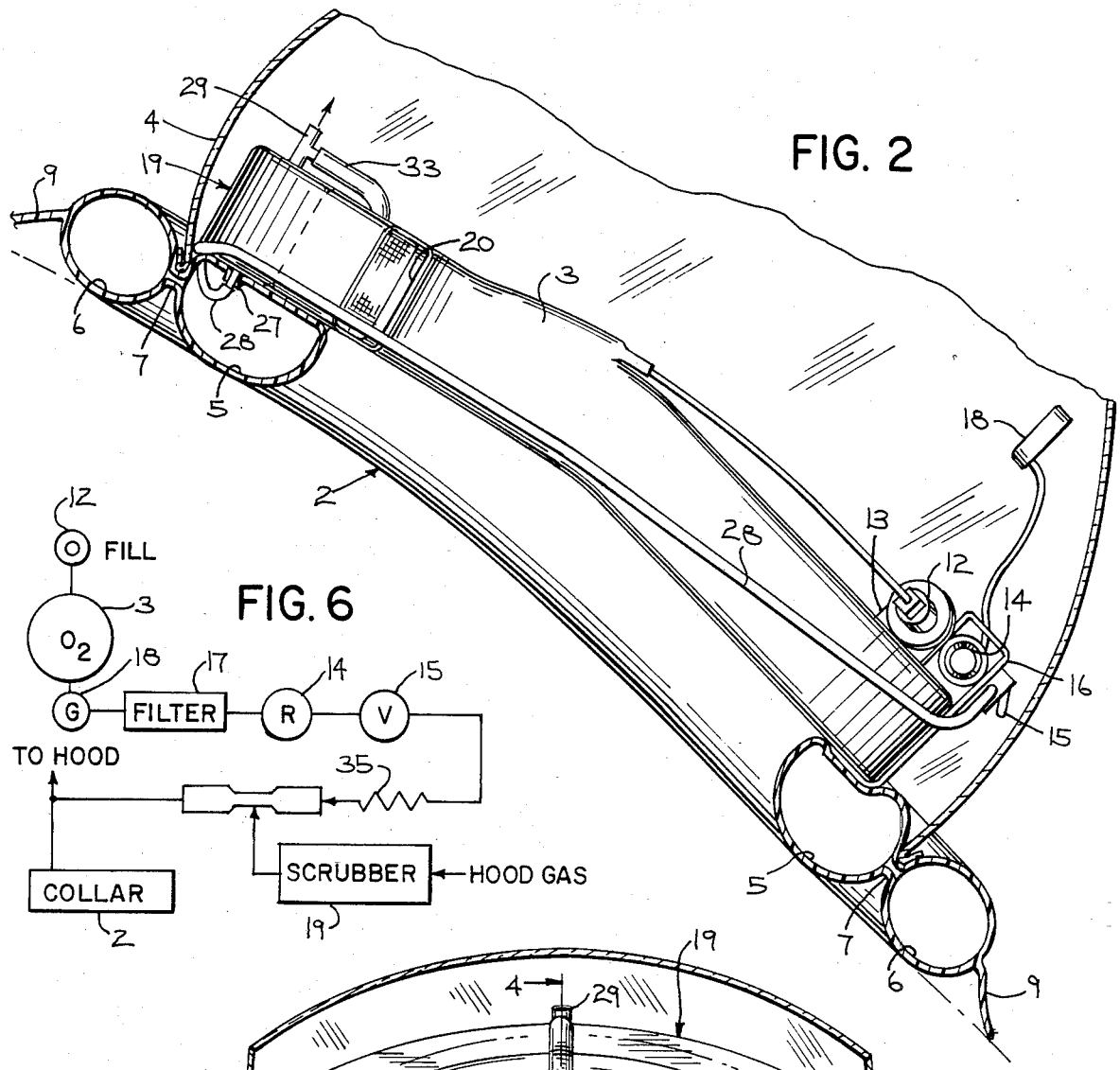
FIG. 2
FIG. 6
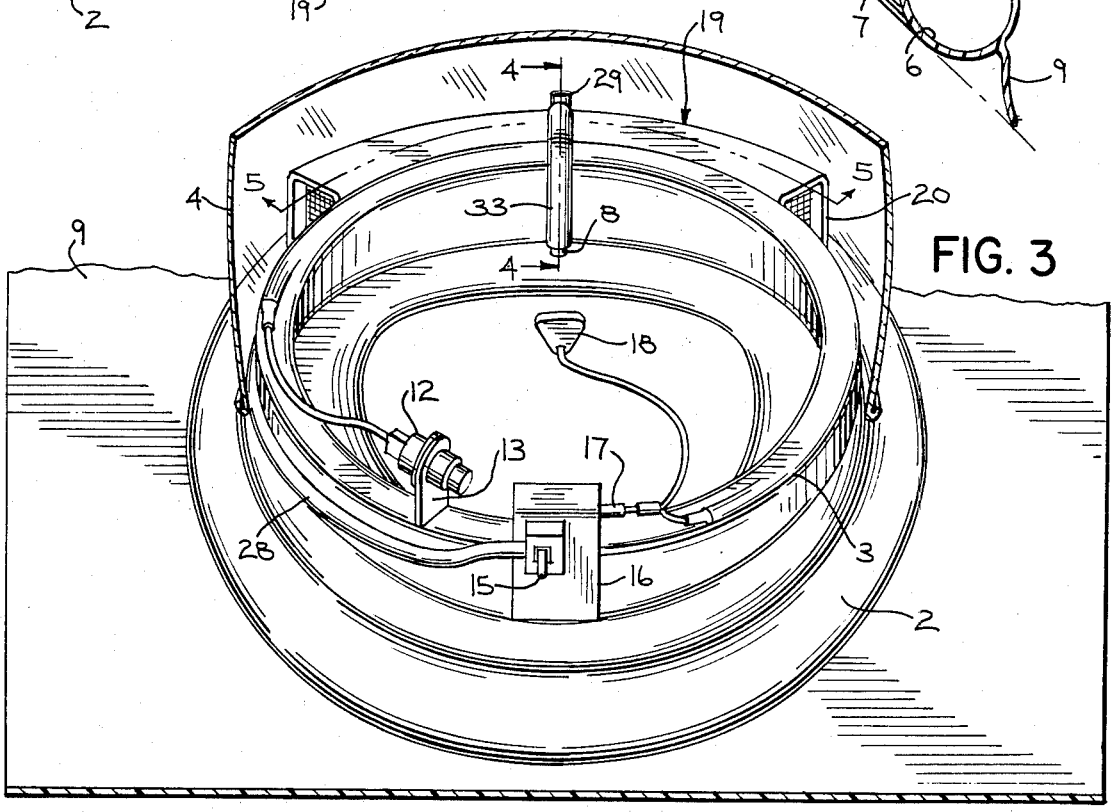
FIG. 3

EMERGENCY ESCAPE DEVICE

BACKGROUND OF THE INVENTION

The present invention relates to breathing equipment and more particularly to an emergency escape device particularly useful for persons desiring to escape from a hostile environment such as a smoke-filled or burning building.

Many situations unexpectedly arise which thrust a person into an emergency situation wherein the ambient air is unbreathable. A typical situation occurs in a smoke-filled or burning building where fire, heavy smoke and other noxious gases may be produced which could trap people therein. Under these conditions, people must evacuate immediately or face suffocation or injury from smoke inhalation. It is therefore desirable to provide an emergency escape device which provides a temporary air supply to the user in a hostile environment.

Various types of emergency escape breathing devices are known which provide protection against hazardous atmospheres. These devices generally comprise a transparent hood that is pulled over the user's head and a pressurized supply of oxygen which is released to the hood. Typical of such escape devices are those found in the following U.S. Pat. Nos. 4,236,514; 4,221,216; 3,762,604; 3,262,407; and 3,080,586. Although such devices all provide emergency breathing support for a person in a hostile environment, there remains a need for an improved device which is more comfortable to the user. In addition, since emergency escape devices must of necessity be lightweight, the air supply of devices which have been developed to date has been limited so that such devices may only be utilized for a relatively short period of time, i.e. 10 to 15 minutes. In certain situations which may be life threatening, such a short term air supply is inadequate. Further, none of the above devices have included any means for recirculating the hood gas to provide extended use.

SUMMARY OF THE INVENTION

An emergency escape device includes a transparent impervious flexible hood sealingly affixed to an inflatable collar which fits over a user's head, and an annular reservoir for containing a supply of pressurized oxygen gas positioned on the collar. Control means actuatable by the user delivers oxygen from the reservoir to simultaneously inflate the hood and collar. When the collar is inflated, the weight of the reservoir seals the collar around the user's neck to prevent the entry of smoke or other noxious gases.

The control means includes a valve located at the front of the reservoir and regulator means between the valve and the reservoir for providing a substantially constant flow of oxygen from the reservoir. The valve may be of the reseatable type so that a user may control the amount of oxygen consumption from the reservoir. Also, such a valve may enable the device to be easily recycled after use.

The reservoir is in the form of a coil of tubing with an inner coil concentric with an outer coil to provide a compact self-contained unit. The reservoir is saddle-shaped to substantially rest on and conform to the shape of the user's thorax, shoulders and nape of the neck. This shape provides comfort to the user and since the reservoir is positioned on top of the inflatable collar its weight seals the collar around the user's neck.

The emergency escape device also employs a recirculatory means within the hood for recycling the hood gas to enable the hood gas to be rebreathed by the user. This recirculatory means provides extended use for the device without substantially increasing its weight or bulkiness. The recirculatory means includes a scrubber for cleansing carbon dioxide from the exhalations of the user and suction means for drawing the hood gas through the scrubber. The scrubber includes a housing that defines a pair of spaced apart scrubbing chambers filled with a carbon dioxide absorptive medium such as soda lime crystals. Further, the scrubber housing includes a pair of auxiliary chambers filled with a moisture absorptive medium such as silica crystals located upstream of the scrubbing chambers.

The suction means includes an ejector located between the scrubbing chambers having a nozzle located at the end of an oxygen supply line and a tubular restrictor mounted on the scrubber housing in alignment with the nozzle. The restrictor includes a restricted orifice therein having an inlet spaced from the nozzle opening and an outlet opening into the hood. The scrubber and ejector enable carbon dioxide to be continuously removed from the hood gas so that extended use of the device can be achieved without substantially increasing its weight while maintaining the concentration of carbon dioxide within tolerable weight. For example, the emergency escape device may be used for about 50 minutes with only 150 liters of oxygen.

The emergency escape device thus provides breathing support to a user in a hostile environment which is lightweight, and comfortable. The device also provides extended use by employing a scrubber and ejector for removing carbon dioxide from the hood gas. Additionally, the device includes a gauge which is visible to the user so that the user knows how much oxygen remains in the reservoir.

BRIEF DESCRIPTION OF THE DRAWINGS

The drawings illustrate the best mode presently contemplated of carrying out the invention.

In the drawings:

FIG. 1 is a perspective view illustrating a person using an emergency escape device constructed in accordance with the principles of the present invention;

FIG. 2 is a fragmentary side view showing the collar in section and illustrating the device of FIG. 1 in its inflated condition;

FIG. 3 is a perspective front view partially in section of the device of FIG. 1;

FIG. 4 is a cross-sectional view taken along the plane of the line 4—4 in FIG. 3;

FIG. 5 is a cross-sectional view taken along the plane of line 5—5 in FIG. 3; and FIG. 6 is a schematic view illustrating the component circuitry for the device of FIG. 1.

DESCRIPTION OF THE PREFERRED EMBODIMENT

Referring now to the drawings, FIG. 1 shows an emergency escape device, generally designated by the numeral 1 which constitutes the preferred embodiment of the present invention. The escape device 1 includes an inflatable collar 2, an annular reservoir 3 for containing a supply of pressurized oxygen gas, and a hood 4. As shown, collar 2 and reservoir 3 have neck openings which are sufficiently large to fit over a user's head.

As seen best in FIG. 2, collar 2 includes an inner tube 5 positioned beneath reservoir 3 and an outer tube 6 surrounding inner tube 5. Tubes 5 and 6 are interconnected with one another by means of a web portion 7 which permits fluid communication therebetween so that when tube 5 is inflated tube 6 will also be inflated. Tube 5 has an inlet 8 (FIG. 3) which is utilized to fill collar 2 with oxygen as will hereinafter be described. A skirt 9 is integrally attached to outer tube 6 and as seen in FIG. 1 covers the user's shoulders and front and rear upper torso. Collar 2 and skirt 9 are preferably comprised of lightweight vinyl material. The vinyl material is flexible thus enabling collar 2 to readily conform to the shape of the user's thorax, shoulder and nape of the neck while at the same time providing an adequate seal around the user's neck to prevent the entry of smoke and noxious gases.

As shown in FIG. 4, reservoir 3 is in the form of a continuous double coil of tubing 10 with an inner coil concentric with an outer coil. The individual sections of tube 10 which make up the inner coil and outer coil are stacked on top of each other and are housed within an enclosure 11. Although shown as a continuous length, tubing 10 may comprise multiple coils interconnected by a manifold. The tubing 10 is preferably constructed of a lightweight metal material while enclosure 11 is of a plastic material. As shown in FIG. 3, a fill valve 12 of conventional construction is connected to one end of tube 10 and is mounted by means of a bracket 13 on top of enclosure 11 near the front of reservoir 3. Thus, reservoir 3 is reusable and may be recharged with additional oxygen after its use.

The other end or outlet end of tube 10 is also located near the front of reservoir 3. As a means for controlling the passage of oxygen through the outlet end of reservoir 3, device 1 includes a regulator 14 and a reseatable oxygen release valve 15. Regulator 14 is mounted on top of reservoir 3 by means of a bracket 16. Regulator 14 functions to provide a substantially constant flow of oxygen from reservoir 3 despite a decrease in pressure within tube 10 as the oxygen is depleted. Regulator 14 may be of any conventional construction but is preferably of the construction shown in U.S. Pat. No. 3,854,495 issued to Cowley on Dec. 17, 1974. As shown in FIG. 6, an air filter 17 is located upstream from regulator 14 and a gauge 18 is located between filter 17 and the outlet of reservoir 3. Gauge 18 may be of any conventional construction and functions to indicate the volume of oxygen remaining in reservoir 3. Gauge 18 projects upwardly from reservoir 3 in front of the user so that the user can readily see how much oxygen is left in reservoir 3. A flow resistor 35 is positioned in line 28 downstream of valve 15 to aid along with regulator 14 in providing a constant flow of oxygen to nozzle 27.

Oxygen release valve 15 is located downstream from regulator 14 and is mounted on the side of bracket 16. Valve 15 may be of the reseatable type and is automatically actuated by donning the hood 4. For example, when hood 4 is extended from its stored position, a trip mechanism automatically opens valve 15 and initiates the flow of oxygen to hood 4.

As shown best in FIG. 2, reservoir 3 is concentrically positioned with collar 2 and is located on top of collar 2 so that when collar 2 is inflated the weight of reservoir 3 seals collar 2 around the user's neck. FIG. 2 also illustrates the shape of reservoir 3. Reservoir 3 is saddle-shaped to subtantially rest on and conform to the shape of a user's thorax, shoulders and nape of the neck. Since collar 2 is constructed of a vinyl material, it will flex under the weight of reservoir 3 and not only conform to the shape of reservoir 3 but also provide a relatively tight seal around the user's neck.

As shown best in FIG. 3, the neck opening of collar 2 is smaller than the neck opening of annular reservoir 3. Although both neck openings are sufficient to enable a user's head to pass therethrough, the smaller opening of collar 2 functions to prevent reservoir 3 from falling through collar 2 when collar 2 is inflated. Thus, reservoir 3 is properly positioned on top of collar 2 to provide a proper seal at all times during use.

Hood 4 is constructed of a transparent impervious flexible material such as clear vinyl and is sealingly affixed to the portion 7 of collar 2. Thus, hood 4 surrounds reservoir 3 so that when valve 15 is actuated, collar 2 and hood 4 form a sealed chamber for receiving the user's head. As shown best in FIG. 1, hood 4 is of a height and width which allows for substantial freedom of movement for the user's head.

The emergency escape device 1 also employs a recirulatory means within hood 4 for recycling the gas within hood 4 to enable the hood gas to be rebreathed by the user. This prolongs or extends the use of device 1 without increasing the reservoir capacity which would undesirably increase the weight and bulkiness of the device. The recirculatory means includes a scrubber 19 for cleansing carbon dioxide from the user's exhalations in the hood gas, and an ejector positioned adjacent to scrubber 19 which creates a venturi effect for drawing the hood gas through scrubber 19. Scrubber 19 is mounted on the rear of reservoir 3 and as shown in FIG. 3 is arc shaped to substantially conform to the shape of reservoir 3. As shown in FIG. 5, scrubber 19 includes a housing 20 that defines a pair of spaced apart scrubbing chambers 21 filled with a carbon dioxide absorptive medium 22, such as soda lime crystals. Each scrubbing chamber 21 is defined by a pair of walls 23 which may be in the form of a screen mesh. Additionally, a paper air filter 24 is positioned adjacent the inner walls 23. Scrubber 19 also includes a pair of spaced apart auxiliary chambers 25 filled with a moisture absorptive medium 26 such as silica crystals. Chambers 25 are located upstream of scrubbing chambers 21 and are located adjacent the inlets to scrubber 19. Each auxiliary chamber 25 is defined on one end by the outer wall 23 of chamber 21 and on the other end by a third wall 34 which may also be constructed of a wire screen mesh. Thus, air being recirculated from hood 4 first passes through the silica crystals 26 in chambers 25 to remove moisture therefrom and then through the soda lime crystals 22 in chambers 21 to remove the carbon dioxide therefrom.

The carbon dioxide absorbing soda lime crystals 22 are placed in close proximity to the reservoir tubing 10 so that the heat produced by the reaction of the carbon dioxide and the soda lime crystals 22 may be dissipated. Also, the cooling effect of the expanding gases in the reservoir tubing 10 helps to absorb some of this heat.

The ejector functions to create a suction for drawing the hood gas through scrubber 19. To accomplish this, the ejector is positioned between the chambers 21 of scrubber 19. As shown best in FIGS. 4 and 5, the ejector includes a nozzle 27 located at the end of an oxygen supply line 29 which leads from oxygen release valve 15, and a restrictor 29. Nozzle 27 is mounted in the bottom wall of housing 20 for scrubber 19 and projects into the space between scrubbing chambers 21. As shown in FIG. 4, nozzle 27 includes a restricted orifice 30 and a diverging section 31 which opens into the space between scrubbing chambers 21.

As shown best in FIGS. 4 and 5, restrictor 29 is in the form of a tubular member mounted to the top wall of housing 20 of scrubber 19 to project therethrough. Restrictor 29 includes a restricted orifice 32 formed therein having an inlet spaced from the outlet of nozzle 27 and an outlet which opens into the interior of hood 4. The inlet to restrictor 29 is located in alignment with the outlet from nozzle 27. A collar fill tube 33 communicates at one end with restrictor 29 at a location between restricted orifice 32 and the outlet to hood 4. The other end of collar fill tube 33 communicates with the inlet 8 of collar 2 so that as oxygen is delivered to hood 4 through restrictor 29 collar 2 is simultaneously inflated.

The optimum performance of nozzle 27 and restrictor 29 is obtained when the maximum desired flow p through the scrubbing material 22 is achieved with a minimum flow and pressure q through outlet tube 28 from reservoir 3. This is obtained by varying the dimensions of orifice 30, section 31, the distance between the outlet of nozzle 27 and the inlet to restrictor 29, and the dimensions of orifice 32 until the optimum results are obtained. For example, for a pressure of 50 psi through outlet tube 28 and a flow p of 3 liters per minute, the diameter of orifice 30 is 0.0135 inches. Preferably, the desired flow through restrictor 29 to the interior of hood 4 is about 8 liters per minute, while the flow from reservoir 3 to nozzle 29 is preferably between about 3.0 to about 3.5 liters per minute. Thus, with an oxygen supply in reservoir 3 of about 150 liters the device 1 provides for about 40 to 50 minutes of use.

Device 1 may be stored in any convenient flocation for use by occupants of a building. In operation, the device 1 is merely removed from its storage compartment and placed over the head of a user. Release valve 15 may then be actuated to an open position so that pressurized oxygen from reservoir 3 is deliverd to nozzle 27 and then through restrictor 29 to the interior of hood 4. Simultaneously, oxygen is delivered through tube 33 to inflate collar 2. Additionally, as oxygen is delivered to hood 4, nozzle 27 and restrictor 29 create a venturi effect which draws the hood gas through the moisture absorbing silica crystals 26 and carbon dioxide absorbing soda lime crystals 22 so that the hood gas may be rebreathed by the user.

An emergency escape device 1 has been illustrated and described which is operational in various hazardous atmospheres. The device 1 includes an inflatable collar 2 and a saddle-shaped oxygen reservoir 3 positioned thereon so that when collar 2 is inflated the weight of reservoir 3 seals collar 2 around the user's neck. Additionally, the device 1 includes a recirculatory means for recycling the hood gas to enable the hood gas to be rebreathed by a user to prolong the oxygen supply without adding to the weight or bulk of the device.

Various modes of carrying out the invention are contemplated as being within the scope of the following claims particularly pointing out and distinctly claiming the subject matter which is regarded as the invention.

We claim:

1. An emergency escape device, comprising:

an inflatable collar having a neck opening sufficiently large to fit over a user's head;

an annular reservoir for containing a supply of pressurized oxygen gas and concentrically positioned on said collar such that, when in use, said collar is located between said reservoir and a user's body so that when said collar is inflated the weight of said reservoir seals said collar around the user's head, said reservoir includes a housing containing a continuous double coil of tubing having an inner coil concentric with an outer coil;

a transparent impervious flexible hood adapted to surround a user's head and having an open end sealingly affixed to said collar around said reservoir and control means associated with said reservoir and actuatable by the user for delivering oxygen from said reservoir to simultaneously fill said hood and inflate said collar.

2. The device of claim 1, wherein said control means includes valve means and regulator means between said valve means and said reservoir for providing a substantially constant flow of oxygen from the reservoir.

3. The device of claim 1, wherein said reservoir is further shaped to substantially conform to the shape of the user's thorax, shoulders and nape of the neck.

4. The device of claim 1, wherein said reservoir includes a central opening, and the neck opening of said collar is smaller than the opening of said annular reservoir.

5. The device of claim 1, wherein said collar includes an inner tube positioned beneath said reservoir connected to and in fluid communication with an outer tube surrounding said inner tube.

6. An emergency escape device, comprising:

an inflatable collar having a neck opening sufficiently large to fit over a user's head;

an annular reservoir for containing a supply of pressurized oxygen gas, said reservoir shaped to substantially rest on and conform to the shape of the user's thorax, shoulders and nape of the neck and concentrically positioned on said collar that, when in use, said collar is located between said reservoir and a user's body so that when said collar is inflated the weight of said reservoir seals said collar around the user's head;

a transparent impervious flexible hood adapted to surround a user's head and having an open end sealingly affixed to said collar around said reservoir;

control means associated with said reservoir and actuatable by the user for delivering oxygen from said reservoir to simultaneously fill said hood and inflate said collar; and recirculatory means within said hood for recycling the gas within said hood to enable said hood gas to be re-breathed by the user.

7. The device of claim 6, wherein said recirculatory means includes a housing containing scrubber means communicating between the interior of said hood and a suction chamber within said housing for cleansing carbon dioxide from the hood gas and suction means in said suction chamber adjacent said scrubber means for drawing said hood gas through said scrubber means.

8. The device of claim 7, wherein said suction means includes an ejector means which creates a venturi effect to cause hood gas to pass through said scrubber means.

9. The device of claim 8, wherein said housing of said scrubber means defines a pair of spaced apart scrubbing chambers filled with a carbon dioxide absorptive medium located on opposite sides of said suction chamber, and said ejector means is positioned between said scrubbing chambers in said suction chamber.

10. The device of claim 9, wherein said reservoir includes an oxygen supply line and said scrubber housing includes an opening therein for receiving said oxygen supply line in the suction chamber between said scrubbing chambers, and said ejector means includes a nozzle located at the end of said supply line mounted on said scrubber housing opening into said suction chamber and a tubular restrictor mounted on said housing in the suction chamber between said scrubbing chambers in alignment with said nozzle, said restrictor including a restricted orifice therein having an inlet spaced from said nozzle and an outlet opening into said hood.

11. The device of claim 10, further including a collar fill tube having one end communicating with said restrictor at a location between said restricted orifice and the outlet of said restrictor, and its other end communicating with said collar so that as oxygen is delivered to the hood through said restrictor the collar is simultaneously inflated.

12. The device of claim 9, wherein said scrubber means further includes a pair of spaced apart auxiliary chambers within said scrubber housing filled with a moisture absorptive medium located upstream of said scrubbing chambers, and said scrubber housing further includes inlet openings communicating with said auxiliary chambers to permit hood gas to pass therethrough into said auxiliary and scrubbing chambers.

13. The device of claim 12, wherein said moisture absorptive medium is silica crystals.

14. The device of claim 9, wherein said carbon dioxide absorptive medium is soda lime crystals.

* * * * *